United States Patent [19]

Ozawa

[11] Patent Number: 4,945,567

[45] Date of Patent: Jul. 31, 1990

[54] METHOD AND APPARATUS FOR SPEECH-BAND SIGNAL CODING

[75] Inventor: Kazunori Ozawa, Tokyo, Japan

[73] Assignee: NEC Corporation, Tokyo, Japan

[21] Appl. No.: 462,981

[22] Filed: Jan. 10, 1990

Related U.S. Application Data

[63] Continuation of Ser. No. 275,703, Nov. 25, 1988, abandoned, which is a continuation of Ser. No. 708,623, Mar. 5, 1985, abandoned.

[30] Foreign Application Priority Data

Mar. 6, 1984 [JP] Japan ..... 59-42307
Apr. 4, 1984 [JP] Japan ..... 59-67114

[51] Int. Cl.[5] ..... G10L 5/00
[52] U.S. Cl. ..... 381/49; 381/36
[58] Field of Search ..... 381/36, 38, 49

[56] References Cited

U.S. PATENT DOCUMENTS 2,908,761 10/1959 Rarsheck ..... 381/38
4,516,259 5/1985 Yato et al. ..... 381/36
4,610,022 9/1986 Kitayama et al. ..... 381/36
4,618,982 10/1982 Horvath et al. ..... 381/36

*Primary Examiner*—Emanuel S. Kemeny
*Attorney, Agent, or Firm*—Sughrue, Mion, Zinn, Macpeak & Seas

[57] ABSTRACT

A method and implementing apparatus for low-bit rate speech band signal coding. An input signal in the speech band is represented by a pulse excitation sequence and a spectral parameter sequence over a frame of predetermined frame length using a selected one of a plurality of pulse determining processing modes. The selected pulse determining processing mode sequentially determines the amplitudes $g_i$ *and locations* $m_i$ of the pulses of the pulse excitation sequence on the basis of the amplitudes and locations of pulses in a previous frame. The selection process of determining which of the pulse determined processing modes to be used involves analyzing the input signal to produce a judgment signal d signifying the input signal as a voiced or an unvoiced signal, and selecting the pulse determining processing mode in response to the judgment signal d. The pulse excitation sequence and spectral parameter sequence are coded for transmission to a suitable receiver. The judgment signal d may also be coded and transmitted to the receiver. The receiver reproduces the input signal from the received coded signal.

13 Claims, 7 Drawing Sheets

METHOD AND APPARATUS FOR SPEECH-BAND SIGNAL CODING

This is a continuation, of application Ser. No. 07/275,703 filed Nov. 25, 1988 which is a continuation of application Ser No. 06/708,623 filed Mar. 5, 1985 both now abandoned.

BACKGROUND OF THE INVENTION:

This invention relates to a method and an apparatus for low-bit rate speech-band signal coding.

There is a known method for searching an excitation sequence of a speech signal at short time intervals as one effective way of speech signal coding at a transmission rate of 16 kbps or less, provided that an error between speech and the signal reproduced using the sequence relative to the input signal is minimal. Multi-pulse excitation method (Prior Art 1) proposed by B. S. Atal et al. at Bell Telephone Laboratories of the United States is worth notice, in that the excitation sequence is represented by a sequence of pulses with the amplitudes as well as phases, which are obtained on the coder side in short time intervals through A-b-S (Analysis-by-Synthesis) based pulse search method. The detailed description of the method will be omitted herein as it appeared in the manuscript collection (ICASSP, 1982) on pp. 614 to 617 (Reference 1); "A new model of LPC excitation for producing natural-sounding speech at low bit rates". The disadvantage of the conventional method referred to as Prior Art 1 is that the calculation amount would become larger since the A-b-S method has been employed to obtain the pulse sequence. On the other hand, there has been proposed another method (Prior Art 2) using correlation functions to obtain the pulse sequence, this method being intended to decrease the calculation amount (refer to U.S. patent application Ser. No. 565,804 now U.S. Pat. No. 4,716,592 and Canadian application No. 444,239 called Reference 2). Excellent reproduced sound quality is available for the transmission rate of 16 kbps or less.

The conventional method using the correlation functions will briefly be described. The excitation sequence comprising k pulses in a frame is represented by the following:

$$d(n) = \sum_{i=1}^{K} g_i \delta(n - m_i),\ n = 0, 1, \ldots, N-1 \tag{1}$$

where: $\delta(\cdot) = \delta$ of KRONECKER; N=frame length; and $g_k$=pulse amplitude at location $m_k$. If a predictive coefficient is assumed to be $a_i$ (i=1, . . . , M, M being the order of a synthesis filter), the reproduced signal x(n) obtained by inputting d(n) to the synthesis filter can be written as:

$$\tilde{x}(n) = d(n) + \sum_{i=1}^{P} a_i \tilde{x}(n-i) \tag{2}$$

The weighted mean-squared error between the input speech signal x(n) and the reproduced signal $\tilde{x}(n)$ calculated in one frame is given by:

$$J = \sum_{n=1}^{N} ((x(n) - \tilde{x}(n)) * W(n))^2 \tag{3}$$

where: * represents convolutional process; and w(n) weighting function. The weighting function is introduced to reduce perceptual distortion in the reproduced speech. According to the speech masking effect, noise in a Formantarea where the speech energy is larger tends to be effectively masked by original speech. The weighting function is determined based on short time speech characteristics. As the weighting function, there is proposed the Z-transform function W(z) using the real constant $\gamma$ and the predictive coefficient $a_i$ of the synthesis filter under the condition of $0 \leqq \gamma \leqq 1$ (see the Reference 1):

$$W(z) = \left(1 - \sum_{i=1}^{P} a_i Z^{-i}\right) / \left(1 - \sum_{i=1}^{P} a_i \gamma_i Z^{-i}\right) \tag{4}$$

If the Z-transforms of the $\tilde{x}(n)$ and x(n) are respectively defined as X(z) and $\tilde{X}(z)$, Equation (3) will be represented by the following:

$$J = |X(z)W(z) - \tilde{X}(z)W(z)|^2 \tag{5}$$

With reference to Equation (2), $\tilde{X}(z)$ will be:

$$\tilde{X}(z) = H(z)D(z) \tag{6}$$

where:

$$H(z) = 1 / \left(1 + \sum_{i=1}^{P} a_i Z^{-i}\right);$$

H(z) is a Z-transform of the synthesis filter; and D(z) is a Z-transformed excitation sequence. Substituting Equation (6) into Equation (5), the following Equation (7) is obtained:

$$J = |X(z)W(z) - H(z)W(z)D(z)|^2 \tag{7}$$

Accordingly, if the inverse Z-transforms of X(z)W(z) and H(z)W(z) are written as $x_w(n) = x(n) * w(n)$ and $h_w(n) = h(n) * w(n)$, respectively, Equation (7) will be:

$$J = \sum_{n=1}^{N} \left(x_w(n) - \sum_{i=1}^{I} g_i h_w(n - m_i)\right)^2 \tag{8}$$

By partially differentiating Equation (8) with $g_i$ and setting the result to 0, the following Equation (9) is obtained:

$$g_i = \left\{\phi_{xh}(m_i) - \sum_{j=1}^{k-1} g_j R_{hh}(m_j, m_i)\right\} R_{hh}(m_i, m_i), \quad i = 1, \ldots, K \tag{9}$$

where: $\phi_{xh}(\cdot)$ expresses a cross-correlation function between the $x_w(n)$ and $h_w(n)$; and $R_{hh}(\cdot)$ covariance function of $h_w(n)$. They are written as follows:

$$\phi_{xh}(m) = \sum_{n=0}^{N-1} x_w(n) h_w(n - m_k) = \phi_{hx}(-m_k), \quad 0 \leqq m \leqq N-1; \tag{10}$$

and

-continued $$R_{hh}(m_i, m_j) = \sum_{n=0}^{Q} h_w(n - m_i)h_w(n - m_j) \quad (11)$$

$$Q = N - \max(m_i, m_j) + 1, 0 \leqq m_i, m_j \leqq N - 1.$$

By properly processing frame edges, the covariance function $R_{hh}(m_i, m_j)$ is replaced by auto-correlation function $R_{hh}(|m_i - n_j)$.

The conventional method 2 (Prior Art 2) determines the k-th pulse amplitude and location by assuming $g_i$ in Equation (9) as a function of only $m_i$. In other words, location $m_i$ maximizing $g_i$ of Equation (9) is obtained as the i-th pulse location and $g_i$ obtained at that time i-th pulse amplitude from Equation (9). In this method, the excitation pulse sequence minimizing J of Equation (8) can be calculated with reduced computation amount.

Since the coding mode at the transmitting side is constant, any of the conventional methods so far described has failed to code the input signals and thus has been unable to produce high quality speech band signals.

SUMMARY OF THE INVENTION:

It is, therefore, an object of this invention to provide a method of and an apparatus for coding speech-band signals, which method can improve quality even at a low-bit transmission rate.

Another object of this invention is to provide a coding method and an apparatus which can reduce transmission bit rate to a lower value.

Still another object of this invention is to provide a coding method and an apparatus which can prevent the speech quality from deteriorating due to quantization error between the coder and decoder sides.

According to the present invention, a method of coding a speech signal is provided in which the speech signal in each frame period is represented by a plurality of excitation pulses and spectral parameters, the excitation pulses representing an excitation signal of the speech signal and having amplitude information and different location information, and the spectral parameters representing spectrum information of the speech signal, the method comprising:

a pulse determining step for determining the excitation pulses from the speech signal in a short time interval which is not shorter than the frame period;

a spectrum determining step for determining the spectral parameters from the speech signal in the frame period;

a decision step for deciding voiced and unvoiced states of the speech signal in response to the spectral parameters determined in the frame period, the decision step thereby generating a judgment signal indicative of which of the voiced and unvoiced states of the speech signal has in the frame period;

a setting step for setting the number of the excitation pulses at L1 and L2 (where L1 and L2 are the first and second predetermined numbers of the excitation pulses in the frame period and L2 is greater than L1) when the judgment signal indicates voiced and unvoiced states, respectively; and a coding step for coding at least the excitation pulses and spectral parameters into a coded signal.

Other objects and features will be clarified from the following description with reference to the drawings.

Figure 1:
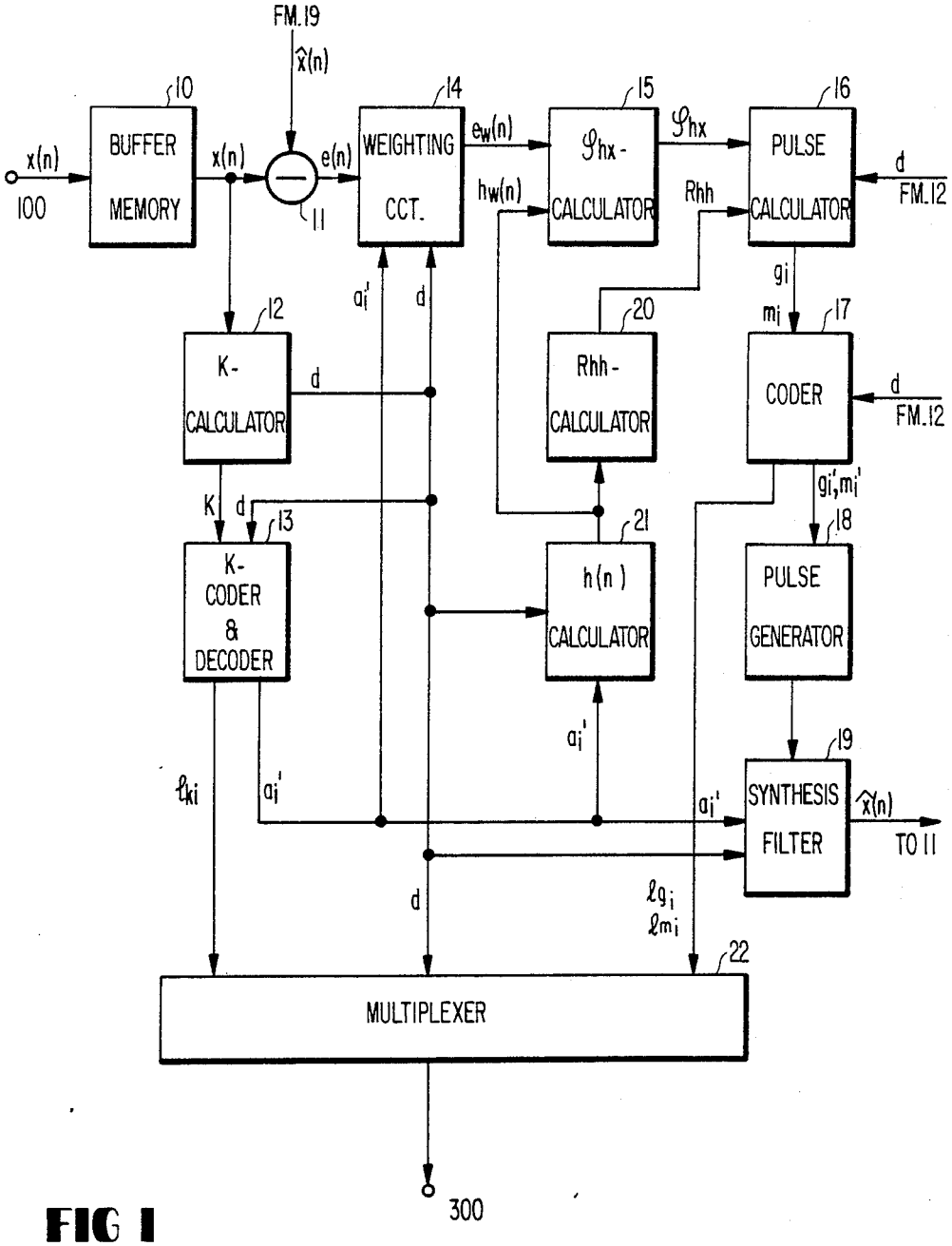
FIG. 1 is a block diagram showing the coder-side structure of a first embodiment of this invention.

DETAILED DESCRIPTION OF THE PREFERRED EMBODIMENTS:

In FIG. 1, there is shown the structure of a coding apparatus according to one embodiment of the present invention. A speech signal x(n) corresponding to a predetermined number of speech inputted from an input terminal 100 are stored for each frame in a buffer memory 10. A K-parameter calculator 12 calculates LPC parameters indicating the spectral envelope of those speech signals read from the buffer memory 10. The LPC parameters are various, and here the following description will be made using a K-parameter the. For calculating the K-parameter, auto-correlation method and covariance method are well known in the art. Here, the calculation of the K-parameter by the auto-correlation method will be described with reference to the method which is disclosed in the papers (Reference 3) entitled "QUANTIZATION PROPERTIES OF TRANSMISSION PARAMETERS IN LINEAR PREDICTIVE SYSTEMS", written by John Makhoul et al. on pages 309 to 321 of IEEE TRANSACTION ON A.S.S.P., in June, 1975, as follows:

$$E_0 = R(0) \quad (12a);$$

$$k_i = -\left[R(i) + \sum_{j=1}^{i-1} a_j^{(i-1)} \cdot R(i-j)\right] / E_{i-1}; \quad (12b)$$

$$a_i^{(i)} = k_i \quad (12c)$$

$$a_j^{(i)} = a_j^{(i-1)} + k_i a_{i-j}^{(i-1)}, \ (1 \leqq j \leqq i-1) \quad (12d)$$

$$E_i = (1 - k_i^2) \cdot E_{i-1} \quad (12e)$$

and $$a_j = a_j^{(p)}, \ (1 \leqq j \leqq p) \quad (12f).$$

The K-parameter can be obtained recursively for j=1, 2, . . . , p by using Equations (12a) to (12f). In these Equations: $k_i$ represents the i-th K-parameter value; R(i) the auto-correlation function at the delay time i for the input speech; p the order of predictor analysis; and $a_j^{(p)}$ the j-th linear predictive coefficient in case of the analysis order p. Moreover, $E_i$ appearing in Equation (12e) represents the predictor error power for the prediction of the order i. Hence, the predictor error power of the order i can be monitored at each step of calculation process. The normalized predictor error power is expressed by using Ei, as follows:

$$V_i = E_i / R(O) \quad (13);$$

and by using Equation (12e) for i=p:

$$V_p = \prod_{i=1}^{P} (1 - k_i^2), \quad (14)$$

where $1/V_p$ is called a "predictor gain". If Equation (14) is used, therefore, the normalized predictor error power can be obtained in the case of the p-th predictor analysis. Thus, the K-parameter is calculated on the basis of the auto-correlation method.

Figure 2:
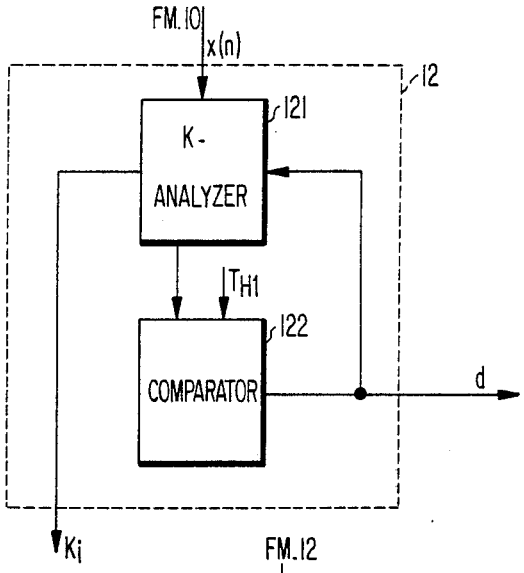
FIG. 2 is a block diagram showing the detail of a K-parameter calculator 12 of FIG. 1.

Reverting to FIG. 1, the K-parameter calculator 12 has such a structure as shown in FIG. 2. First of all, a K-analyzer 121 calculates K-parameters $K_i$ ($1 \leqq i \leqq M_1$) up to a predetermined order $M_1$ (e.g., $M_1=4$) in accordance with Equations (12a) to (12e) to send the obtained K-parameters to a K-parameter coder and decoder 13. In accordance with Equation (14), moreover, the K-analyzer 121 calculates a normalized predictor error power $V_{M1}$ of $M_1$-th order to supply the error power $V_{M1}$ to a comparator 122. The comparator 122 compares the obtained normalized predictor error power $V_{M1}$ with a predetermined threshold value $T_{H1}$ and judges that the input speech is voiced or unvoiced when the error power $V_{M1}$ is smaller or larger than the value $T_{H1}$, to output a judgement signal d of 1 bit. This voiced-unvoiced decision is based upon that the voiced portion of the speech signal has a high correlation between the sample signals have a high predictive accuracy so that the normalized predictor error power takes a considerably small value, whereas the unvoiced portion of the speech signal and the data modem signal have a low correlation there is difficulty in the prediction (or have a low predictive accuracy) so that the normalized predictor error power does not take such a low value.

The K-analyzer 121 outputs the K-parameter values $K_i$ up to the $M_1$-th order ($1 \leqq i \leqq M_1$, e.g., $M_1=4$) to the K-parameter coder and decoder 13, in case the judgement signal d indicates the unvoiced decision. Since the correlation between the speech signals is small in case they are unvoiced, the improvement in the predictive gain is very low, even if the $M_1$ is 4 or more, and the calculation amount is to be reduced by setting the minimum order at 4. In case it is judged that the speech signals are voiced, the K-analyzer 121 continues to calculate the K-parameter values $K_i$ ($1 \leqq i \leqq M_2$) up to a higher order $M_2$ ($M_2 \geqq M_1$, e.g., $M_2=12$) so as to more finely express the spectral envelope of the speech signals, and outputs the $K_i$ ($1 \leqq i \leqq M_2$) to the K-parameter coder and decoder 13.

Figure 3:
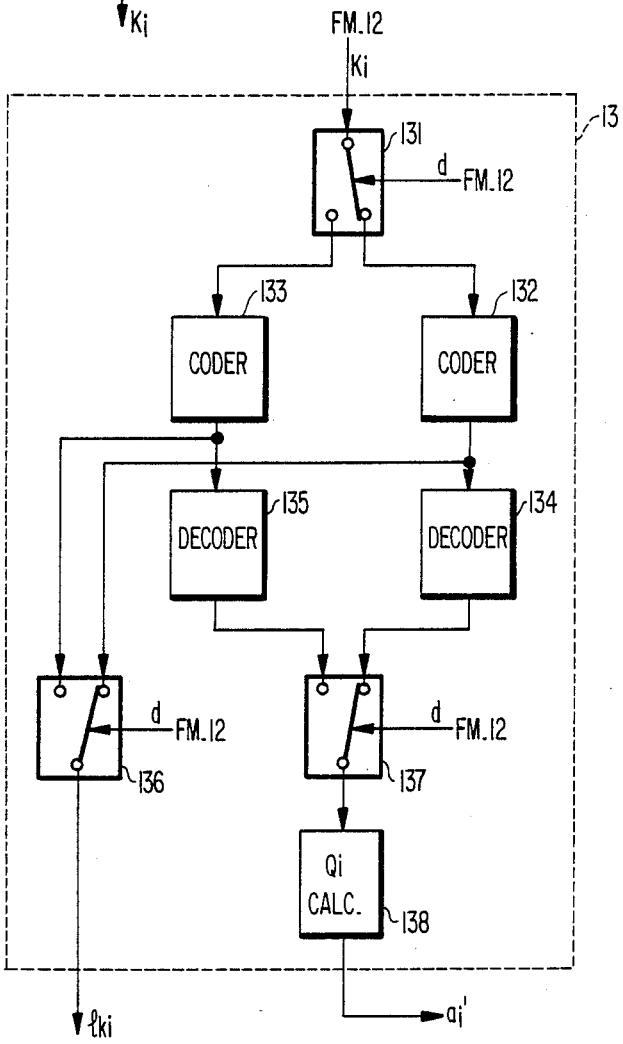
FIG. 3 is a block diagram showing the detail of a K-parameter coder and decoder 13 of FIG. 1.

The K-parameter coder and decoder 13 has such a structure as is shown in FIG. 3 and receives the voiced-unvoiced judgement signal d and the K-parameter signal $K_i$ from the K-calculator 12. The K-parameter coder and decoder 13 is equipped with coders 132 and 133, which have optimum quantizing characteristics for both the voiced and unvoiced signals (e.g., the quantizing characteristics for quantizing the signals in accordance with the voiced and unvoiced decisions in a manner to correspond to different occurrence distributions), and have their coders 132 and 133 switched by a switch 131 in accordance with the judgement signal d to output the coded signal $l_{ki}$ of the K-parameter $K_i$ to a multiplexer 22 through a switch 136 which is adapted to be switched in accordance with the judgement signal d. The K-parameter coder and decoder 13 is further equipped with decoders 134 and 135 for decoding the coded signal $l_{ki}$ in a manner to correspond to the decoders 132 and 133, respectively, and the decoders 134 and 135 send out the decoded outputs for the voiced and unvoiced decisions to an $a_i$ calculator 138 for calculating a predictive coefficient ($a_i$), when they are switched by a switch 137 in response to the judgement signal d. The $a_i$ calculator 138 calculates and outputs a predictive coefficient $a'_i$ on the basis of the aforementioned Equations (12c), (12d) and (12f) by using the decoded K-parameter value $K'_i$. At this time, it is apparent that the order p of the predictive coefficient to be determined is set to $M_1$ or $M_2$ on the basis of the result of the voiced-unvoiced decision of the speech signals.

Here, the predictive coefficient $a'_i$ is calculated not from the uncoded K-parameter value but from the decoded K-parameter value in the $a_i$ calculator 138. This is because it is preferable to use the K-parameter value which is used for synthesis at the speech synthesizing side (i.e., at the decoder side). Although it is possible to use at the coder side the uncoded and undecoded values in place of the decoded K-parameter values, quality deterioration due to the quantizing error is caused between the coder and decoder sides.

An impulse response (h(n)) calculator 21 receives the predictive coefficient $a'_i$ and the judgement signal d and calculates weighted impulse response $h_w(n)$. The transfer function of the calculator 21 is expressed by the following equation.

$$H_w(Z) = W(Z) / \left(1 - \sum_{i=1}^{P} a'_i Z^{-i}\right), \quad (15)$$

where P represents the order of the predictive coefficient $a'_i$ to be determined. This Equation (15) is simplified by substituting the W(Z) of the foregoing Equation (4). The order P is so changed in accordance with the judgement signal d that it is set to $M_2$ (e.g., 12) for the voiced signal and to $M_1$ (e.g., 4) for the unvoiced signal. The h(n)-calculator 21 outputs the weighted impulse response $h_w(n)$ thus obtained to an $R_{hh}$-calculator 20 and a $\phi_{hx}$-calculator 15.

In response to the weighted impulse response $h_w(n)$ signal, the $R_{hh}$-calculator 20 calculates the autocorrelation function $R_{hh}(\cdot)$ for a predetermined delay time $\tau$ in accordance with the following Equation:

$$R_{hh}(\tau) = \sum_{n=1}^{N-\tau} h_w(n) h_w(n+\tau) \quad (16)$$

The auto-correlation function $R_{hh}(\tau)$ signal thus obtained is outputted to a pulse calculator 16.

In response to the speech signal x(n) stored in the buffer memory 10, a subtractor 11 subtracts the output signal of a synthesis filter 19 from the signal x(n) by one-frame sample to output the subtracted result or the predictive error signal e(n) to a weighting circuit 14. This will be described in detail in the following.

In response to the subtracted result e(n) from the subtractor 11 and the predictive coefficient $a'_i$ from the K-parameter coder and decoder 13, the weighting circuit 14 weights the subtracted result e(n) in accordance with the voiced-unvoiced decision indicated by the judgement signal d and outputs a weighted error $e_w(n)$ to the $\phi_{hx}$-calculator 15. This error $e_w(n)$ is written by the Z-transform expression, as follows:

$$E_w(Z)=E(Z)\,W(Z) \tag{17}$$

where $E_w(Z)$ and E(Z) represent the Z-transforms of the $e_w(n)$ and e(n), respectively. Incidentally, the order p of W(Z) is changed to $M_2$ or $M_1$ in accordance with the voiced-unvoiced judgement signal d.

In response to $e_w(n)$ from the weighting circuit 14 and the weighted impulse response $h_w(n)$ from the h(n)-calculator 21, the $\phi_{hx}$-calculator 15 calculates the cross-correlation function $\phi_{hx}(n)$ by a predetermined number of samples in accordance with the following Equation:

$$\phi_{hx}(m) = \sum_{n=1}^{N} e_w(n)\cdot h_w(n-m),\ (1 \leqq m \leqq N). \tag{18}$$

The pulse calculator 16 calculates the optimum excitation pulse sequence on the basis of $\phi_{hx}(\cdot)$ and $R_{hh}(\cdot)$. At this time, the pulse calculator 16 changes and sets the number of pulses to be determined within one frame in response to the judgement signal d. In other words, the calculator 16 determines $L_1$ pulses for the voiced signal and $L_2$ pulses for the unvoiced signal. Here, it is assumed that $L_1<L_2$. The reason why it is necessary to increase the pulse number for the unvoiced signal than for the voiced signal is that the predictor gain is lower for the unvoiced signal than for the voiced signal, as has been described hereinbefore. Here, the pulse number has to be determined in accordance with the transmission bit rate. If this bit rate is assumed to be 16 kbits/-sec., for example, $L_1$ is 32 for the voiced signal, and $L_2$ is 50 for the unvoiced signal in accordance with the quantizing bit allocation in a later-described coder circuit.

The pulse calculator 16 calculates pulses one by one in accordance with the following Equation so as to minimize the weighting error power between the input signal and the synthesis signal:

$$g_i(m_i) = \left\{ \phi_{hx}(m_i) - \sum_{l=1}^{i-1} g_l\cdot R_{hh}(|m_l - m_i|) \right\} / R_{hh}(0), \tag{19}$$

$$(1 \leqq i \leqq L),$$

where: $g_i$ represents the amplitude of the i-th pulse in the frame; and $m_i$ the location of the i-th pulse in the frame. Moreover, L represents the number of pulses to be determined in one frame, which value is changed to the $L_1$ (for the voiced signal) or $L_2$ (for the unvoiced signal) in accordance with the voiced-unvoiced judgement signal d, as has been described hereinbefore. The location $m_i$ of the pulses is determined from a position in the frame, in which the $g_i$ takes the maximum absolute value.

Figure 4A:
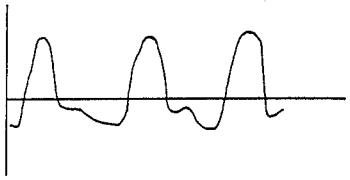
FIGS. 4A to 4E are time charts showing one example of the pulse search procedure at a pulse calculator 16 of FIG. 1.
Figure 4B:
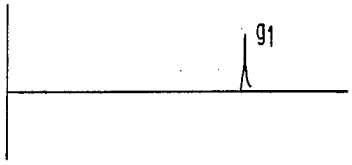
Figure 4C:
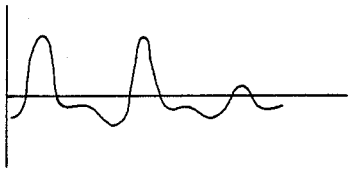
Figure 4D:
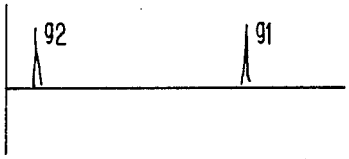
Figure 4E:
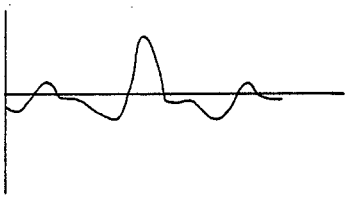

Next, the procedures for determining the pulses one by one in accordance with Equation (19) will be described with reference to FIGS. 4A to 4E. Of these, FIG. 4A shows the cross-correlation function of one frame, which is calculated by the $\phi_{hx}$-calculator 15 and outputted to the pulse calculator 16. In FIG. 4A, the abscissa designates the sample times in one frame. The frame length is set to 160. The ordinate designates the amplitudes. FIG. 4B shows the firstly determined pulse $g_l$ that is derived in accordance with Equation (19). FIG. 4C is a time chart after the influences of the pulse determined in FIG. 4B are subtracted. FIG. 4D shows $g_1$ and a secondly determined pulse $g_2$. FIG. 4E is a chart after the influences of the second pulse $g_2$ are subtracted. $L_1$ or $L_2$ pulses are determined by repeating the procedures shown in FIGS. 4D and 4E. The algorithm thus far described for determining the pulse sequence is disclosed in detail in the foregoing Reference 2.

Reverting to FIG. 1, a coder 17 receives the pulse sequence from the pulse calculator 16 and the judgement signal d from the K-parameter calculator 12 to switch the quantization bit and the quantization characteristics for the voiced and unvoiced signals like the K-parameter coder and decoder 13 in accordance with the judgement signal d. The reason why the quantization characteristics are changed is to perform the optimum quantization for both voiced and unvoiced distributions because the distributions of the pulse amplitudes become different between the voiced and unvoiced signals. The coder 17 codes the amplitudes $g_i$ and the locations $m_i$ of the pulses inputted and outputs them to the multiplexer 22 as codes $l_{gi}$ and $l_{mi}$. On the other hand, the coder 17 outputs the decoded values $g'_i$ and $m'_i$ of the amplitudes and locations of the pulses to a pulse generator 18. A variety of pulse sequence coding methods can be considered. One is a method of separately coding the amplitudes and locations of the pulse sequence, and the other is a method of coding the amplitudes and locations together.

One example of the former method will be described in the following. First of all, as the method of coding the amplitudes of the pulse sequence, there can be conceived a method in which the amplitudes of the respective pulses in a frame are quantized and coded after they have been normalized by using absolutely maximum value among the pulses as the normalizing coefficient. As the quantization characteristics, there are used the optimum characteristics which accord the amplitude distributions for the voiced and unvoiced signals, respectively. On the other hand, the amplitudes of the respective pulses may be quantized and coded after they have been transformed to other parameters having an orthogonal relationship. The bit assignment may be changed for each pulse amplitude. Next, a variety of methods are conceivable for coding the pulse locations. For example, there may be used run length codes or the like, which are well known in facsimile signal coding. According to the run length coding, the length of run having a series of codes "0" or "1" is expressed in terms of a predetermined coding sequence. For coding the normalizing coefficient, on the other hand, there can be used the logarithmically compressed coding which is well known in the prior art.

Next, one example of the quantized bit allocation for the voiced and unvoiced signals will be described in the following. The transmission bit rate is set to 16 kbit/sec. If the judgement signal d is voiced, the number of quantization bits of the pulse amplitude and location are set to 5 bits, and the number of quantization bits representing duration between pulse locations is set to 3 bits. In case of the judgement signal is unvoiced, on the other hand, the quantization bit number of the pulse amplitude and location are set to 4 and 2 bits, respectively. In accordance with these quantization bit allocations, the pulse number for the voiced signal is about 32, and the pulse number for the unvoiced signal is about 50, as has been described hereinbefore.

As to the coding of the pulse sequence, it is possible to use not only the coding system thus far described but also other known coding methods.

Now, the pulse generator 18 generates the excitation pulse sequence having the amplitude $g'_i$ at the location $m'_i$ by using the decoded values $g'_i$ and $m'_i$ of the pulse sequence and sends it to the synthesis filter 19.

In response to the signals $g'_i$, $m'_i$, d and $a'_i$, the synthesis filter 19 generates a response signal sequence $\hat{x}(n)$ in accordance with the following equation by using the excitation pulse sequence and the decoded predictive coefficient value $a'_i$:

$$\hat{x}(n) = d(n) + \sum_{i=1}^{P} a'_i \cdot \hat{x}(n-i). \tag{20}$$

Here, $\hat{x}(n)$ is calculated over two frames, i.e., the present (or first) frame and the subsequent (or second) frame ($1 \leqq n \leqq 2N$). The d(n) represents the excitation signal, for which the excitation pulse sequence outputted from the pulse generator 18 is used for $1 \leqq n \leqq N$. For $N+1 \leqq n \leqq 2N$, on the other hand, there is used the sequence in which all the values are 0. The order P is changed in accordance with the judgement signal d so that it is set to $M_2$ (e.g., 12) for the voiced signal and to $M_1$ (e.g., 4) for the unvoiced signal. In the $\hat{x}(n)$ determined by Equation (20), $\hat{x}(n)$ of the second frame ($N+1 \leqq n \leqq 2N$) is outputted to the subtractor 11. At the next frame, this subtractor 11 subtracts the signal $\hat{X}(n)$ of the second frame supplied from the synthesis filter 19 from the signal x(n) supplied from the buffer memory 10 and outputs the error e(n).

In order to prevent the quality deterioration due to the discontinuity of the waveforms at the frame boundary to the minimum level and to provide high quality, the subtractor 11 in the embodiment described above subtracts the response signal sequence reconstructed using the excitation pulses prior by one frame from the input speech of the present frame. This processing is described in detail in the aforementioned Reference 2.

The forementioned deterioration in the speech quality due to the discontinuity at the frame boundary can also be reduced by the following manner.

Figure 5:
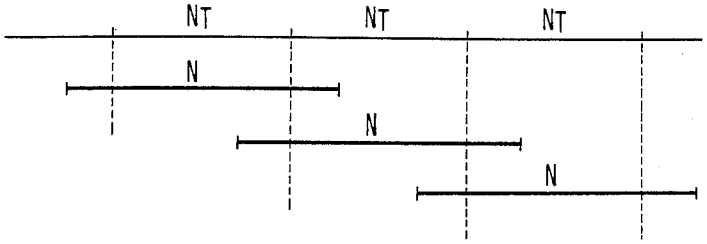
FIG. 5 is a diagram showing frame structures of a transmission frame and search frame capable of simplifying the structure of the apparatus according to this invention.

In FIG. 5, $N_T$ designates the frame for transmitting the pulses, and N designates the short time interval for calculating the pulses. According to this structure, the response signal sequence need not be calculated so that the apparatus structure can be simplified. In this case, the pulses to be transmitted at the coder side are those which come into the $N_T$ section. Since the section N for calculating the pulses is longer than $N_T$, it is necessary to determine a slightly larger number of pulses. Despite of this necessity, the total calculation amount is remarkably reduced.

Returning to FIG. 1, the multiplexer 22 responds to the output code $l_{ki}$ of the K-parameter coder and decoder 13, the codes $l_{gi}$ and $l_{mi}$ judgement signal d, and the amplitudes $g_i$ and locations $m_i$ of the excitation pulses thus processed above and combines them to output the combined codes to a communication path from a sending side output terminal 300.

Next, the receiving (or decoder) side will be described in the following with reference to FIG. 6. In response to the combined code signal inputted from a decoder side input terminal 400, a demultiplexer 41 obtains and supplies a K-parameter code signal, a pulse sequence code signal and a voiced-unvoiced judgement code signal to a K-parameter decoder 42, and a $g_i$ and $m_i$ decoder 43, respectively.

In response to the voiced-unvoiced judgement signal d and the pulse sequence, the $g_i$ and $m_i$ decoder 43 decodes $L_1$ (e.g., 32) pulses in the voiced case in accordance with the voiced-unvoiced judgement signal. In the unvoiced case, on the other hand, the decoder 43 decodes $L_2$ (e.g., 50) pulses. The amplitudes and locations of the pulse sequences thus decoded are supplied to a pulse generator 44. The pulse generator 44 generates an excitation pulse sequence to output it to the synthesis filter 45 responsive to the decoded amplitude and location data.

Responsive to the voiced-unvoiced judgement signal and the K-parameter, the K-parameter decoder 42 decodes the K-parameter of the $M_2$-th (e.g., 12th) order in the voiced case and the K-parameter of the $M_1$-th (e.g., 4th) order in the unvoiced case. The K-parameter value $K_i$ thus decoded and determined is supplied to the synthesis filter 45.

The synthesis filter 45 receives the voiced-unvoiced judgement signal, the generated excitation pulse sequence and the decoded K-parameter value $K_i$. The value $K_i$ is transformed into the predictive coefficient $a'_i$ by using the foregoing Equations (12c), (12d) and (12f). At this time, the maximum order p to be determined is switched and set to $M_1$ or $M_2$ in accordance with the voiced-unvoiced judgement signal. The synthesis filter 45 calculates the synthesized signal $\tilde{x}(n)$ in one frame in accordance with the following Equation and outputs it from a receiving side output terminal 500:

$$\tilde{x}(n) = d(n) + \sum_{i=1}^{P} a'_i \cdot \tilde{x}(n-i), \ (1 \leqq n \leqq N) \tag{21}$$

where d(n) represents the excitation sequence. Moreover, the order p is switched and set to $M_1$ or $M_2$ in accordance with the voiced-unvoiced judgement signal.

Another embodiment of this invention will be described with reference to FIGS. 7 to 9. This embodiment is intended to reduce the transmission capacity by eliminating the voiced-unvoiced judgement signal d from the signal which is sent out from the sending (or coder) side. In short, like the function of the embodiment shown in FIG. 1, the judgement signal is prepared and used for changing the order and the quantizing mode but not sent to a multiplexer. At the receiving (or decoder) side, on the other hand, the voiced-unvoiced judgement signal is generated on the basis of the signal (e.g., the spectral data) sent from the sending side.

Figure 7:
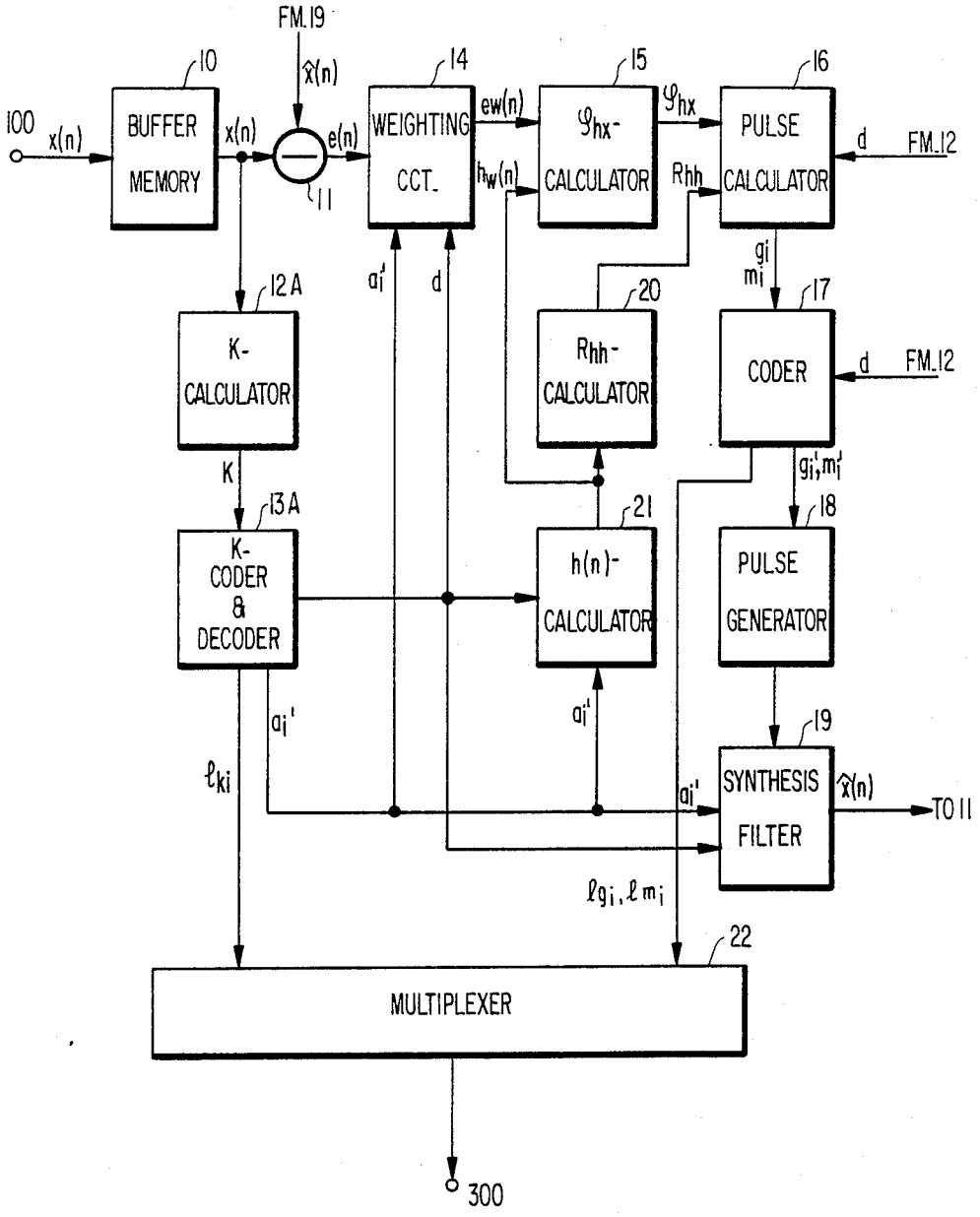
FIG. 7 is a block diagram showing the structure at the coder side of a second embodiment of this invention.
Figure 8:
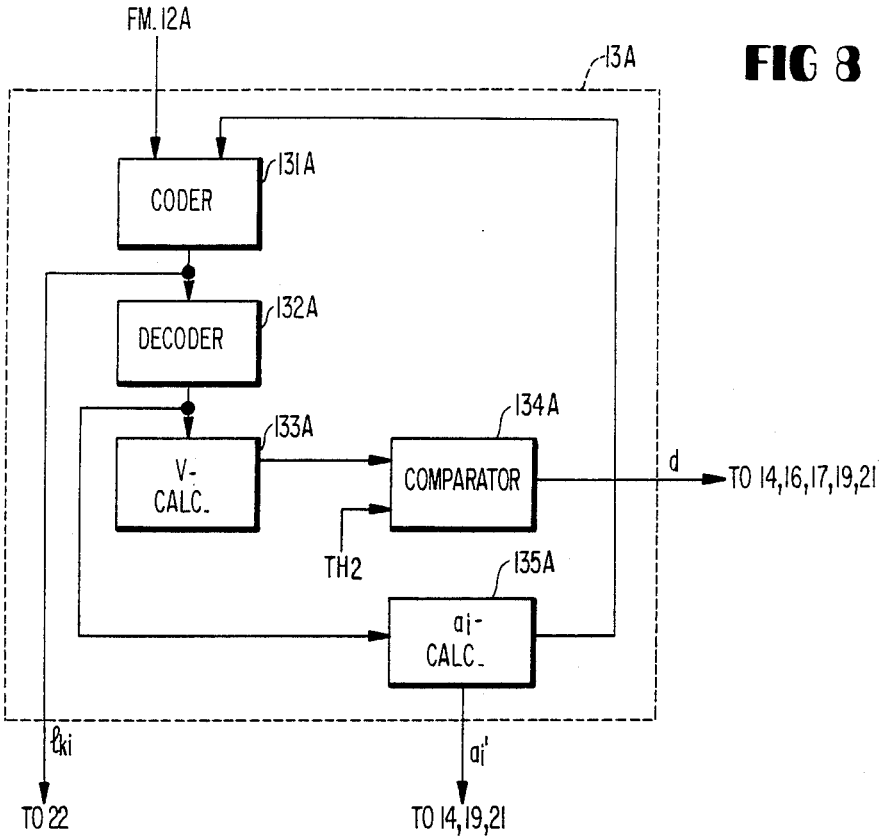
FIG. 8 is a block diagram showing the detail of a K-parameter coder and decoder 13A of the embodiment shown in FIG. 7.

FIG. 7 is a block diagram showing the structure of the sending side of this embodiment. The blocks with the same reference numerals as those in FIG. 1 are those having the same functions. The differences from the embodiment of FIG. 1 resides in that the judgement signal d is generated by a K-parameter coder and decoder 13A, and in that the signal d is not fed to the multiplexer 22. The generation of the judgement signal d may be conducted by the K-calculator 12, as shown in FIG. 1. According to this embodiment, the judgement signal d at the receiving side is generated on the basis of the decoded value of the K-parameter received so that the speech quality deterioration due to the quantizing error between the sending and receiving sides is suppressed.

FIG. 7 will be described in the following without repeating the description of FIG. 1. A K-parameter calculator 12A determines the K-parameter from the speech signal in each frame, which is read out from the buffer memory 10, by using the similar structure to that of the K-analyzer 121 in FIG. 2 and feeds it to the K-parameter coder & decoder 13A. This circuit 13A has such a structure as is shown in FIG. 8, and codes the K-parameter of the order up to $M_1$ by using the K-parameter $K_i$. A decoder 132A decodes the coded K-parameter and sends the decoded value to an $a_i$-calculator 135A and a normalized predictor error power (V) calculator 133A. The V-calculator 133A calculates the normalized predictor error power $V_{M1}$ of $M_1$-th order prediction by using the foregoing Equation (14) and sends out it to a comparator 134A. The comparator 134A compares the error power $V_{M1}$ with a predetermined threshold value $T_{H2}$ to make the voiced-unvoiced judgement and outputs the judgement signal d. A coder 131A codes the K-parameter up to the higher order $M_2$ ($M_2 > M_1$), in case the judgement signal d indicates the voiced stage, and outputs the coded K-parameter to the decoder 132A. In case the judgement signal d indicates the unvoiced state, on the other hand, the coding of the K-parameter is conducted up to the aforementioned $M_1$ order. In response to the decoded K-parameter value, the $a_i$-calculator 135A calculates the predictive coefficient $a'_i$ of the $M_2$-th order in the case the signal d indicates the voiced state and the coefficient $a'_i$ of the $M_1$-th order in case of the unvoiced state by using the judgement signal d from the comparator 134A and feeds $a'_i$ to the weighting circuit 14, the synthesis filter 19 and the h(n)-calculator 21. The calculation of the predictive coefficient $a'_i$ is performed based on the same principle as that of the $a_i$-calculator 138 in FIG. 3. The code $l_{ki}$ of the K-parameter is sent to the multiplexer 22.

Figure 6:
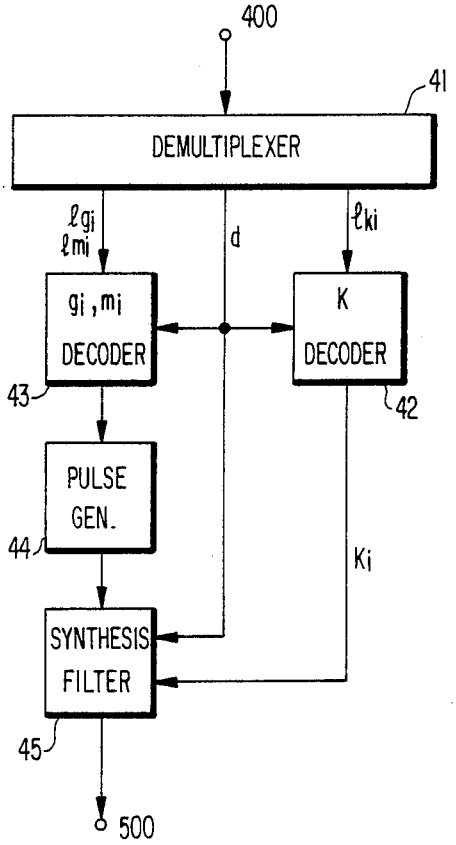
FIG. 6 is a block diagram showing the structure at the decoder side of the first embodiment of this invention.

The structure at the receiving side of this embodiment is basically the same as that for the foregoing first embodiment (as shown in FIG. 6), but is different in that the K-parameter decoder generates the judgement signal d on the basis of the decoded K-parameter. Here, only the structure of the K-parameter decoder 42A in this embodiment is described using FIG. 9.

Figure 9:
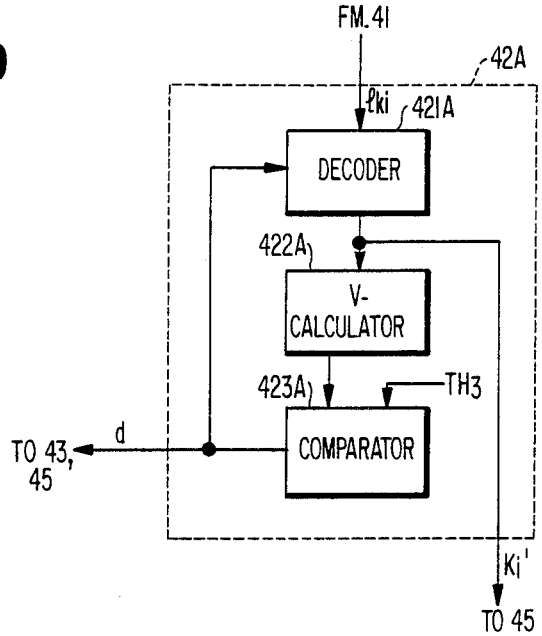
FIG. 9 is a block diagram showing the structure of the K-parameter decoder of the second embodiment of this invention.

In FIG. 9, coded K-parameter signal $l_{ki}$ is supplied from the demultiplexer 41 to a decoder 421A. The decoder 421A first decodes the K-parameter of up to $M_1$-th order and feeds the decoded parameter to a normalized predictor error power (V) calculator 422A. The V-calculator 422A has the same structure as the V-calculator 133A in FIG. 8 and sends the normalized predictor error power $V_{M1}$ of the $M_1$-th order to a comparator 423A. The comparator 423A compares the error power $V_{M1}$ with a predetermined threshold value $T_{H3}$ to make the voiced-unvoiced judgement and outputs the judgement signal d to the decoder 421A, the $g_i$ and $m_i$ decoder 43 and the synthesis filter 45. When the judgement signal d indicates the voiced state, the decoder 421A decodes the K-parameter of the higher order $M_2$ ($M_1 > M_2$). The decoded K-parameter $K'_i$ from the decoder 421A is fed as spectral data to the synthesis filter 45.

Although the signals to be processed in the embodiments thus far described are limited to the speech signals, it is apparent that this invention can be applied to the so-called "data modem signals". This is because the data modem signals have smaller correlations between the sample values than that for speech signals so that the excitation signals are considered random noise signal. Therefore, this invention is applicable to the data modem signals by using a similar process in which a predetermined number of multi-pulses to be determined is set for the unvoiced signal in the foregoing embodiments. In addition to the above, this invention can be modified in various manners.

Since the pulse sequence is determined in accordance with Equation (19) in the present invention, it is possible to remarkably reduce the calculation amount compared with the A-b-S method exemplified in the Reference 1. In other words, it does not need the process in which the reconstructed speech is calculated, mean squared error between the reconstructed speech and the original speech is calculated and the error is fed back to adjust the pulses. Thus, by using this invention, excitation pulses can be determined with remarkably reduced computation amount. It is noted here that the pulse calculating algorithm should not be limited to the methods thus far described in connection with the embodiments but may resort to the A-b-S method, as exemplified in the Reference 1, if the increase in the calculation amount is permitted.

Incidentally, in the pulse calculation algorithm expressed by Equation (19), the pulses can be calculated consecutively one by one on the basis that the amplitudes of the plural pulses determined in the past is readjusted. As the method of determining the speech source pulses, another satisfactory pulse sequence calculation may be used.

In this embodiment, moreover, the normalized predictor error power is calculated at the coder side in accordance with the Equation (14), and is used for voiced-unvoiced judgement. The following method can be also considered for judging the voiced-unvoiced state. Let it be assumed now that the transmission bit rate be 16 kbits/sec. The pulse calculator determines the $L_1$ (e.g., 50) pulses in case of unvoiced state, and the coder 17 exerts the quantization of four bits upon the amplitude of each pulse and express each pulse location with the codes of two bits. The amplitude and location of each pulse are decoded to calculate an error power El in accordance with the following equation:

$$E_i' = R_{ee}(0) - \sum_{i=1}^{L} g'_i \cdot \phi_{hx}(m'_i), \tag{22}$$

where: $R_{ee}(O)$ represents the output power $e_w(n)$ of the weighting circuit 14; L the number ($L_1$ in this case) of pulses; $g'_i$ the decoded pulse amplitude of an i-th pulse; $m'_i$ the decoded location of the i-th pulse; and $\phi_{hx}(\cdot)$ the cross-correlation function. Moreover, $L_2$ (e.g., 32) pulses whose pulse number corresponds to the voiced state are selected among the $L_1$ pulses in the order from those of the larger amplitudes so that they are subjected to quantization of 5 bits for each pulse amplitude by the coder 17 and are coded into 3 bits for each pulses location. Coded pulse amplitudes and locations are decoded in the coder 17. An error power $E_2$ is calculated in accordance with the above Equation (22) by using the decoded value. Here, the value L in Equation (22) has to be set to $L_2$. Next, the powers $E_1$ and $E_2$ are compared. If the value $E_1$ is smaller than $E_2$, the state is judged to be unvoiced, and the judgement code is set to that indicating the unvoiced state so that the pulse number is set at $L_1$. If the value $E_2$ is smaller than $E_1$, on the other hand, the state is judged to be voiced, and the judgement code is set to that indicating the voiced state so that the pulse number if set to $L_2$. By using the structure described above, the voiced-unvoiced judgement can be conducted in accordance with the overall performance including the quantizing effects so that the judgement is optimally performed.

In this embodiment, moreover, by using the voiced-unvoiced judgement signal, the quantization characteristics and the quantization bit allocations are switched at the coder side whereas the decoding characteristics of the K-parameters are also switched at the decoder side. In order to further simplify the apparatus structure, the quantization characteristics, the quantization bit allocation and the decoding characteristics may be identical without being changed in accordance with the voiced-unvoiced states.

In this embodiment, still moreover, by using the voiced-unvoiced judgement signal, the order of the K-parameter is changed at the coder side whereas the orders of the K-parameter coder and decoder and the synthesis filter are changed at the decoder side. Despite of this fact, these changing operations concerning those orders need not be conducted.

In this embodiment, furthermore, the order of the synthesis filter is changed in response to the voiced-unvoiced judgement signal, the pulse number L to be determined within the frame is changed in the pulse calculator 16 by using the voiced-unvoiced judgement signal. However, these changing operations using the voiced-unvoiced judgement signal need not be conducted because the order of the K-parameter decoded value has already been changed in response to the voiced-unvoiced judgement signal, and the pulse number to be calculated by the pulse calculator 16 may be set to the same number for both the voiced and unvoiced states and calculated to the value $L_1$ (e.g., 50). The number of pulses to be transmitted may be changed by using the voiced-unvoiced judgement signal in the multiplexer 22, when the codes indicating the pulse sequence are to be transmitted in the multiplexer 22. In case such structure is adopted, $L_2$ (e.g., 32) pulses may be selected among the $L_1$ pulses and transmitted when the transmission is to be conducted by changing the pulse number to a smaller value ($L_2$).

In this embodiment, furthermore, the number of pulses are changed between two states. However, the pulse number may be changed to three or more, this improves the speech quality for the speech signals which are not clear whether they belong to the voiced or unvoiced signals. In this case, it is necessary to prepare three or more kinds of threshold values for the voiced-unvoiced judgements and to increase the number of the bits of the judgement codes to be transmitted to the decoder side.

As is well known in the digital signal processing field, the auto-correlation function of the impulse response has a corresponding relationship to the power spectrum of the speech. Therefore, the structure may be made such that the power spectrum of the speech signal is firstly determined by using the decoded K-parameter so that the corresponding relationship is then used to calculate the auto-correlation function. Furthermore, the cross-correlation function $\phi_{hx}(\cdot)$ has a corresponding relationship to the cross-power spectrum, therefore, the construction may be made such that the cross-power spectrum is firstly determined by using the $e_w(n)$ and the decoded K-parameter so that the cross-correlation function is then calculated.

In this embodiment, the coding pulse sequence in one frame is conducted after the pulse sequence has been wholly determined. The coding may be performed for each calculation of pulses to improve the speech quality. This is because the pulse sequence is determined such that the errors including the coding distortions are minimized.

According to this embodiment, the deterioration of the reproduced signals in the vicinity of the frame boundaries due to the discontinuity of the waveforms at the frame boundaries is remarkably reduced. This is provided by the structure in which, when the pulse sequence of the present frame is to be calculated at the coder side, the response signal is calculated by exciting the synthesis filter with the excitation pulse and is elongated to the present frame. Pulse sequence of the present frame is calculated for the result of subtracting the elongated signal from the input speech signal. In this embodiment, furthermore, the description has been made in case the frame length is constant. However, the frame length may be made such that it is changed with time. Furthermore, the number of the pulses to be calculated in one frame need not be constant. For example, the number of the pulse in each frame may be so changed as to make the S/N ratio constant.

In the present invention, other parameters such as LSP parameter indicating the spectral envelope of the short-time speech signal sequence may be used instead of K-parameter. According to the present invention, it is possible not only to improve the quality of the consonant portion of the speech signal, which might be difficult to attain excellent quality in case the conventional methods are used, but also to transmit in an excellent manner the data modem signals in a speech band.

What is claimed is:

1. A method of coding a speech signal in which the speech signal in each frame period is represented by a plurality of excitation pulses and spectral parameters, said excitation pulses representing an excitation signal of said speech signal and having amplitude information and different location information and said spectral parameters representing spectrum information of said speech signal, said method comprising:

a pulse determining step for determining said excitation pulses from said speech signal in a short time interval which is not shorter than said frame period;

a spectrum determining step for determining said spectral parameters from said speech signal in said frame period;

a decision step for deciding voiced and unvoiced states of said speech signal in response to the spectral parameters determined in said frame period, said decision step thereby generating a judgment signal indicative of which of said voiced and unvoiced states said speech signal has in said frame period;

a setting step for setting the number of said excitation pulses at first and second predetermined numbers L1 and L2 (where L1 and L2 are the numbers of said excitation pulses in said frame period and L2>L1) when said judgment signal indicates the voiced and unvoiced states, respectively; and a coding step for coding at least said excitation pulses and spectral parameters into a coded signal.

2. A method according to claim 1, further comprising a setting step for setting the order of said spectral parameters to be determined in said spectrum determining step to a predetermined order M1 and M2 (where M1 and M2 are preselected numbers and M2>M1) when said judgment signal indicates the unvoiced and voiced states, respectively.

3. A method according to claim 1, wherein said decision step determines the voiced and unvoiced states by comparing a normalized predictor error power obtained from the spectrum information of said speech signal with a predetermined threshold value, said decision step making said judgment signal indicate said voiced and unvoiced states when said normalized predictor error power is smaller and is not smaller than said predetermined threshold value, respectively.

4. A method according to claim 1, wherein said coding step comprises a quantizing step for quantizing said excitation pulses and spectral parameters in accordance with said judgment signal into a quantized pulse sequence and a quantized parameter signal and a step of using at least said quantized pulse sequence and quantized parameter signal as said coded signal.

5. A method according to claim 1, wherein said short time interval is longer than said frame period, including portions of frames before and after said frame period.

6. A method according to claim 1, further comprising:

a decoding step for decoding said coded signal into decoded excitation pulses and decoded spectral parameters; and a synthesizing step for generating a synthesized signal in response to the decoded excitation pulses, the decoded spectral parameters and the judgment signal.

7. A method according to claim 1, said coded signal comprising a coded pulse sequence and a coded parameter signal into which the excitation pulses and spectral parameters are coded, respectively, said method further comprising:

a demultiplexing step for demultiplexing said coded signal into a demultiplexed pulse signal and a demultiplexed parameter signal representative of said coded pulse sequence and coded parameter signal, respectively;

a judging step for judging from said demultiplexed parameter signal whether the speech signal in each frame period is in a voiced or an unvoiced state, said judging step thereby generating a decoder judgment signal indicative of said voiced and unvoiced states;

a decoding step for decoding said demultiplexed pulse signal and demultiplexed parameter signal in response to said decoder judgment signal into decoded excitation pulses and decoded spectral parameters; and a synthesizing step for producing a synthesized signal in response to said decoded excitation pulses, decoded spectral parameters and decoder judgment signal.

8. A method according to claim 7, wherein said judging step is conducted by comparing a normalized predictor error power, which is obtained on the basis of the decoded spectral parameters, with a predetermined threshold value to make said decoder judgment signal indicate the voiced or unvoiced states when said normalized predictor error power is smaller and is not smaller than said predetermined threshold value, respectively.

9. A speech signal coding method in which a speech signal in each frame period is represented by a plurality of excitation pulses and spectral parameters, said excitation pulses representing an excitation signal of said speech signal and having amplitude information and different location information and said spectral parameters representing spectrum information of said speech signal, said method comprising the steps of:

at a transmitting side:

inputting said speech signal in said frame period;

extracting said spectral parameters from said speech signal in said frame period;

determining said excitation pulses from said speech signal in said frame period;

judging whether said speech signal is in a voiced or an unvoiced state in said frame period;

setting the number of said excitation pulses at first and second predetermined numbers L1 and L2 (where L1 and L2 are the numbers of said excitation pulses in said frame period and L2>L1) when a result of said judging step indicates the voiced and unvoiced states, respectively;

coding said spectral parameters and excitation pulses into coded spectral parameters and coded excitation pulses;

at a receiving side:

separating and decoding the coded spectral parameters and coded excitation pulses into decoded spectral parameters and decoded excitation pulses; and reproducing said speech signal in response to at least the decoded spectral parameters and decoded excitation pulses.

10. A speech signal coding apparatus in which a speech signal in each frame period is represented by a plurality of excitation pulses and spectral parameters, said excitation pulses representing an excitation signal of said speech signal and having amplitude information and different location information and said spectral parameters representing spectrum information of said speech signal, said apparatus comprising:

first means for determining said spectral parameters from said speech signal in said frame period;

second means for determining said excitation pulses from said speech signal in a short time interval which is not shorter than said frame period;

third means for judging whether said speech signal is in a voiced or an unvoiced state in said frame period, said third means producing a judgment result signal indicative of which of said voiced and unvoiced states said speech signal has in said frame period;

fourth means for setting the number of the excitation pulses at first and second predetermined numbers L1 and L2 (where L1 and L2 are the numbers of said excitation pulses in said frame period and L2>L1) when said judgment result signal indicates the voiced and unvoiced states, respectively; and fifth means for coding at least said spectral parameters and excitation pulses.

11. An apparatus according to claim 10, further comprising sixth means for making said spectral parameters have, in response to the judgment result signal, orders M1 and M2 (where M1 and M2 are first and second preselected numbers and M2>M1) when said judgment result signal indicates the unvoiced and voiced states, respectively.

12. A method according to claim 1, wherein said short time interval is equal to said frame period.

13. An apparatus for coding a speech signal into a coded signal with said speech signal represented by spectrum information and a plurality of excitation pulses in each frame period and for decoding said coded signal into a synthesized signal representative of said speech signal, said apparatus comprising:

parameter calculating means supplied with said speech signal for calculating spectral parameters representative of said spectrum information in said frame period;

deciding means supplied with said spectral parameters for deciding whether said speech signal is in a voiced or an unvoiced state in said frame period, said deciding means thereby producing a judgment result signal indicative of which of said voiced and said unvoiced states said speech signal has in said frame period;

pulse calculating means supplied with said speech signal and said judgment result signal for calculating said excitation pulses in a short time interval, which comprises said frame period and is not shorter than said frame period, as calculated pulses up to first and second predetermined numbers when said judgment result signal represents said voiced and said unvoiced states, respectively, said first predetermined number being smaller than said second predetermined number;

coding means for coding said spectral parameters and said calculated pulses collectively into said coded signal;

decoding means for decoding said coded signal separately into decoded parameters and decoded pulses in each frame period, said decoded parameters and said decoded pulses representing the spectral parameters and the calculated pulses of said frame period;

judging means supplied with said decoded parameters for judging whether said voiced or said unvoiced state is had by said speech signal in said frame period, said judging means thereby producing a decoder judgment result signal indicative of the voiced and the unvoiced states as judged by said judging means; and synthesizing means controlled by said decoder judgment result signal for synthesizing said decoded parameters and said decoded pulses into said synthesized signal.

* * * * *